US007453218B2

(12) United States Patent
Guthrie

(10) Patent No.: US 7,453,218 B2
(45) Date of Patent: Nov. 18, 2008

(54) PROGRAMMABLE DICHROMATIC LEGEND LIGHTED SWITCHES

(75) Inventor: Don W. Guthrie, Colleyville, TX (US)

(73) Assignee: Aerospace Optics, Inc., Fort Worth, TX (US)

( * ) Notice: Subject to any disclaimer, the term of this patent is extended or adjusted under 35 U.S.C. 154(b) by 46 days.

(21) Appl. No.: 11/081,004

(22) Filed: Mar. 15, 2005

(65) Prior Publication Data

US 2005/0231946 A1 Oct. 20, 2005

Related U.S. Application Data

(60) Provisional application No. 60/553,266, filed on Mar. 15, 2004.

(51) Int. Cl.
*H05B 37/00* (2006.01)
*F21V 33/40* (2006.01)

(52) U.S. Cl. ..... 315/312; 362/800

(58) Field of Classification Search ..... 315/169.1, 315/169.3, 169.4, 312, 314, 129–133; 362/800, 362/555, 559, 561, 84, 103, 105, 612–613
See application file for complete search history.

(56) References Cited

U.S. PATENT DOCUMENTS 3,664,248 A * 5/1972 Mueller ..... 353/20
4,131,777 A * 12/1978 Bailey et al. ..... 200/311
6,016,038 A * 1/2000 Mueller et al. ..... 315/291
6,265,984 B1 * 7/2001 Molinaroli ..... 340/815.4
6,577,080 B2 * 6/2003 Lys et al. ..... 315/362
6,608,332 B2 * 8/2003 Shimizu et al. ..... 257/98
6,627,829 B2 * 9/2003 Sato ..... 200/310
6,726,112 B1 * 4/2004 Ho ..... 236/94
6,876,143 B2 * 4/2005 Daniels ..... 313/504
7,053,601 B1 * 5/2006 Fenske et al. ..... 324/127
7,075,423 B2 * 7/2006 Currie ..... 340/467
2003/0019733 A1 1/2003 Sato

FOREIGN PATENT DOCUMENTS

DE 100 14 221 A1 10/2001
EP 0 463 285 A1 1/1992
EP 1 523 021 A1 4/2005

* cited by examiner

*Primary Examiner*—Douglas W. Owens
*Assistant Examiner*—Min Dieu A

(57) ABSTRACT

Illumination color for a dedicated legend display area of an illuminated pushbutton switch may be programmed by controlling application of the driving voltage to one of two or more different groups of interleaved LEDs alternately illuminating the display area. Each of the different LED groups illuminates the display area with a different color, produced by different color LEDs, filtering of individual LEDs within each group, or dip-coating the LEDs. Application of the driving voltage to different switch input pins causes the legend to be illuminated by different LED groups in different colors, reflecting different conditions.

20 Claims, 4 Drawing Sheets

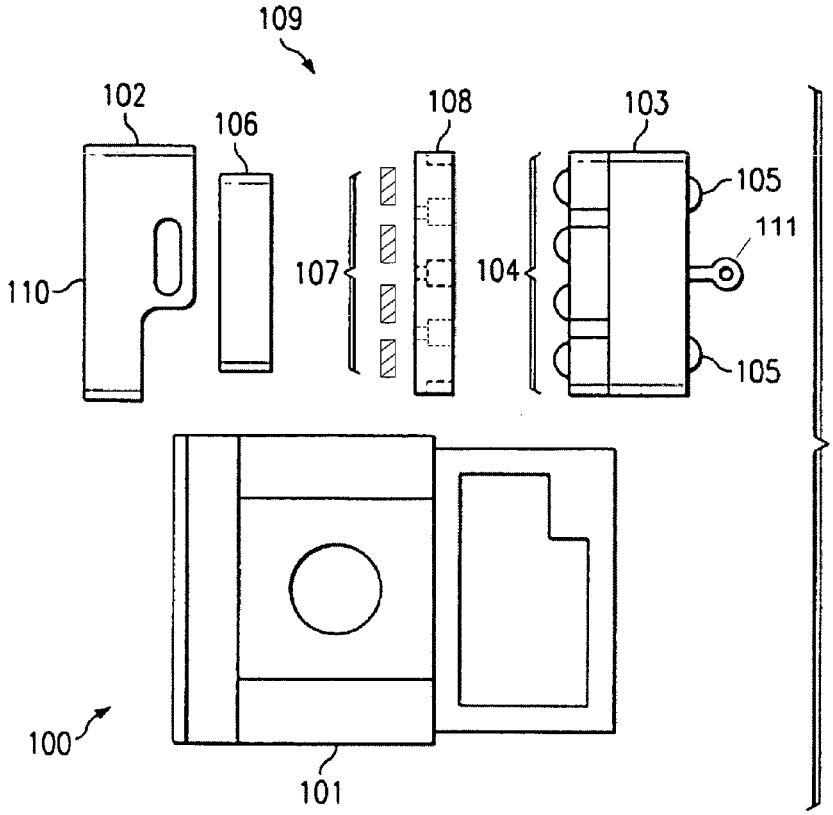
FIG. 1C
FIG. 1D
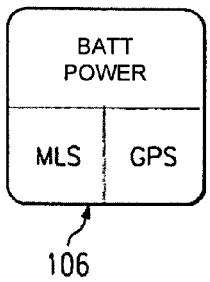
FIG. 1E
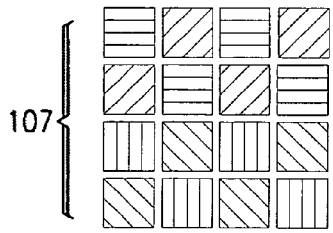
FIG. 1F
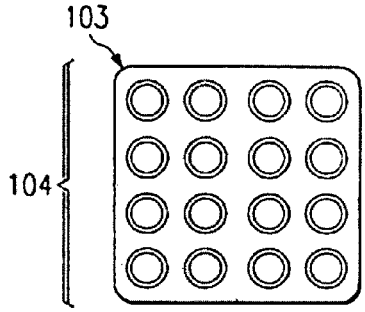

PROGRAMMABLE DICHROMATIC LEGEND LIGHTED SWITCHES

This application claims the benefit of U.S. Provisional Patent Application No. 60/553,266 filed Mar. 15, 2004, the subject matter of which is incorporated by reference herein.

TECHNICAL FIELD OF THE INVENTION

The present invention is directed, in general, to voltage-controlled dimming illuminated displays and, more specifically, to programmable dichromatic displays illuminated by voltage-controlled dimming light emitting diodes.

BACKGROUND OF THE INVENTION

The crewstation instrumentation panels for commercial and military aircraft, naval vessels and tracked and armored vehicles, like many other display systems, frequently employ illuminated indicators and controls. The illumination may be optically filtered to produce a wide range of human visible or night vision imaging system (NVIS) colors, including blue, green, yellow, red and white or the NVIS colors of NVIS blue, NVIS white, NVIS green A (blue-green), NVIS green B (green), NVIS yellow (yellow) and NVIS red (orange-red). In addition, multiple lamps are used within the same display to illuminate different regions of the display separately, providing, for example, four separate legends, each individually illuminated, on the same display for a single illuminated pushbutton switch, indicator or annunciator.

Within dedicated legend illuminated pushbutton switches, for example, the legend is typically illuminated to indicate a first condition or state, and non-illuminated to indicate a second condition or state. For instance, illumination of the legend indicates actuation of the switch to a "closed" state, while the hidden or non-illuminated legend indicates that the switch is in an "open" state.

Color filters are often employed to adjust the spectral radiance of the illumination source(s) to meet the desired chromaticity coordinates and luminance levels at maximum rated voltage(s). By combining multiple illumination sources and different color filters, displays can have multiple legends that each light in a different color.

In many situations, it is desirable to have the legend for a pushbutton switch remain illuminated but use different indicia to indicate the state of the switch or the corresponding element controlled by the switch, such as by changing the color of the illumination.

There is, therefore, a need in the art for programmable illumination of dedicated legend pushbutton switches in which a single legend may be selectively illuminated in any of at least two different colors.

SUMMARY OF THE INVENTION

To address the above-discussed deficiencies of the prior art, it is a primary object of the present invention to provide, for use in aircraft crewstation displays, programmable dichromatic illumination for a single display region, which in the present invention is achieved by utilizing an array of white light emitting diodes to produce illumination optically filtered by separate filters to produce the two or more desired output illumination colors at a desired luminance when the full rated voltage is applied to the light emitting diodes. Programmability of illumination color for a dedicated legend display area is achieved by controlling application of the driving voltage to one of two or more different groups of interleaving LEDs alternately illuminating the same display area. Each of the different LED groups illuminates the display area with a different color, produced by different color LEDs, filtering of individual LEDs within each group, or dip-coating the LEDs. Application of the driving voltage to different switch input pins causes the same legend region to be illuminated by different LED groups in different colors, reflecting different conditions.

The foregoing has outlined rather broadly the features and technical advantages of the present invention so that those skilled in the art may better understand the detailed description of the invention that follows. Additional features and advantages of the invention will be described hereinafter that form the subject of the claims of the invention. Those skilled in the art will appreciate that they may readily use the conception and the specific embodiment disclosed as a basis for modifying or designing other structures for carrying out the same purposes of the present invention. Those skilled in the art will also realize that such equivalent constructions do not depart from the spirit and scope of the invention in its broadest form.

Before undertaking the DETAILED DESCRIPTION OF THE INVENTION below, it may be advantageous to set forth definitions of certain words or phrases used throughout this patent document: the terms "include" and "comprise," as well as derivatives thereof, mean inclusion without limitation; the term "or" is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, whether such a device is implemented in hardware, firmware, software or some combination of at least two of the same. It should be noted that the functionality associated with any particular controller may be centralized or distributed, whether locally or remotely. Definitions for certain words and phrases are provided throughout this patent document, and those of ordinary skill in the art will understand that such definitions apply in many, if not most, instances to prior as well as future uses of such defined words and phrases.

BRIEF DESCRIPTION OF THE DRAWINGS

For a more complete understanding of the present invention, and the advantages thereof, reference is now made to the following descriptions taken in conjunction with the accompanying drawings, wherein like numbers designate like objects, and in which:

FIGS. 1A through 1F depict a perspective assembled view, a perspective exploded view, and an exploded side view of a programmable dichromatic illuminated display pushbutton switch, together with front views of various components thereof, according to one embodiment of the present invention;

DETAILED DESCRIPTION OF THE INVENTION

FIGS. 1A-1F, 2A-2C and 3, discussed below, and the various embodiments used to describe the principles of the present invention in this patent document are by way of illustration only and should not be construed in any way to limit the scope of the invention. Those skilled in the art will understand that the principles of the present invention may be implemented in any suitably arranged device.

Figure 1A:
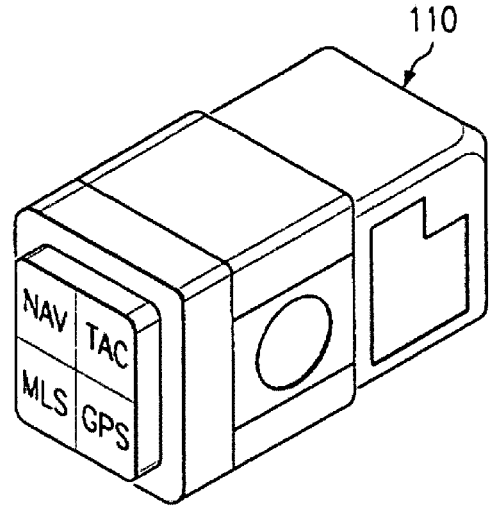
Figure 1B:
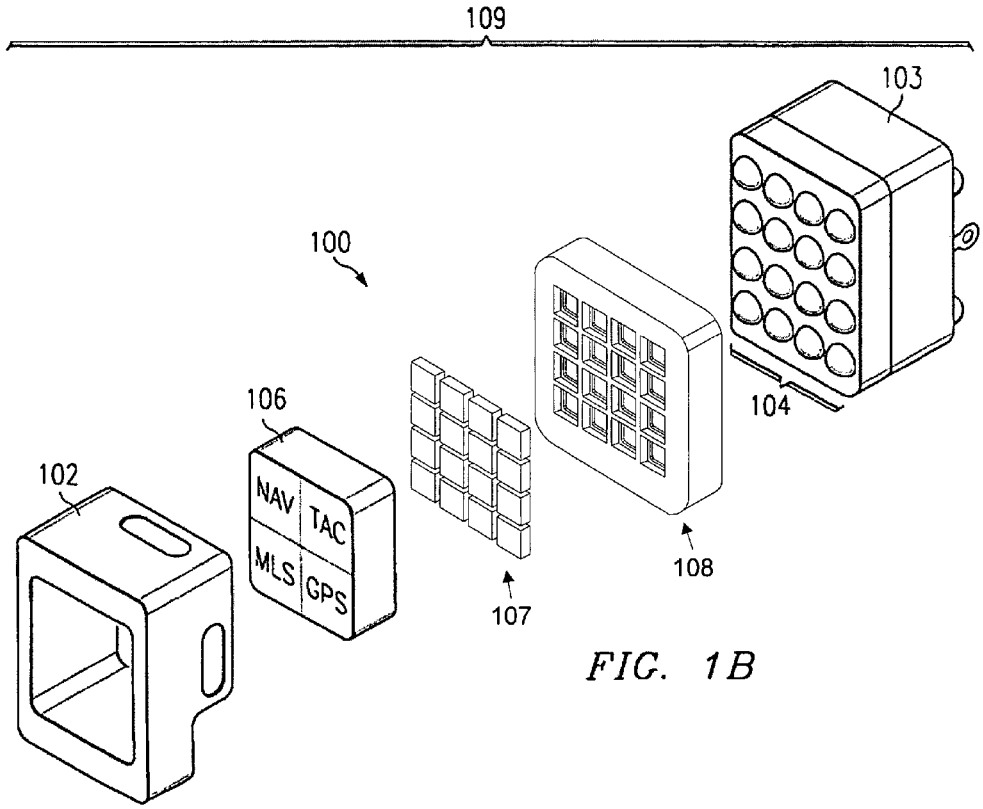

FIG. 1A depicts a perspective, assembled view of a programmable dichromatic illuminated display pushbutton switch according to one embodiment of the present invention. FIG. 1B depicts a perspective, exploded view of a portion of the same programmable dichromatic illuminated display pushbutton switch, and FIG. 1C depicts an exploded side view of the same programmable dichromatic illuminated display pushbutton switch. The programmable dichromatic illuminated display is implemented within an illuminated pushbutton switch in the exemplary embodiment, although skilled artisans will recognize that the present invention may be employed in conjunction with other types of illuminated displays, including but not limited to indicators and annunciators. Moreover, for simplicity the complete structure and operation of an illuminated pushbutton switch is not depicted or described herein. Instead, only so much of the structure and operation of a pushbutton switch as is unique to the present invention or necessary for an understanding of the present invention is depicted and described.

Illuminated pushbutton switch 100 includes a switch housing 101 receiving a switch cap 109 having a display surface 110 on which illuminated legends are visible or hidden, and which is pressed to actuate the switch. Pushbutton switch cap housing 102 receives an array of light emitting diode (LED) or incandescent lamp light sources 104 within a lamp mount 103, which also contains the driver circuits for voltage-controlled dimming of the light sources 104, with input pin contacts 105 provided for making electrical connection to receive a voltage for driving the light sources 104 and common or ground contacts 111 for completing the driving circuit.

As seen in FIGS. 1A and 1B, legend plate 106 in the exemplary embodiment may contain as many as four separate visible legends ("NAV", "TAC", "MLS" AND "GPS" in the example depicted) on the display surface 110, one in each of four quadrants. In the present invention, two legends, each in one half (divided horizontally or vertically) of the display surface 110, or three legends (one in one half and two each in one of the remaining two quadrants) are employed. In either case, at least one of the legends visible on the display surface 110 is programmably illuminated in different colors.

As seen in FIGS. 1B and 1F, the array 104 of light sources 104 is, in the exemplary embodiment, a 4×4 array of sixteen light emitting diodes. For programmable dichromatic illumination according to the present invention, the light emitting diodes within at least two adjacent quadrants (i.e., one half of the display) are driven as part of two interleaved groups, as described in further detail below. For the remaining quadrants the light emitting diodes may optionally be driven as a single group, so that all light emitting diodes within that quadrant are either on or off. Each interleaved group of light emitting diodes for a display area half, or the light emitting diodes for a quadrant, employs a separate voltage-controlled dimming driver circuit as described in further detail below.

Figure 2A:
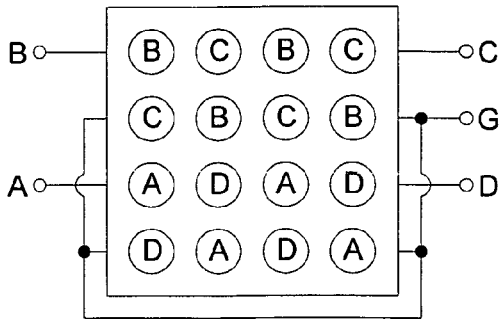
FIGS. 2A through 2C are schematic diagrams illustrating connection of interleaved half-display and/or quadrant groups of light emitting diodes within a programmable dichromatic illuminated display pushbutton switch according to one embodiment of the present invention.
Figure 2B:
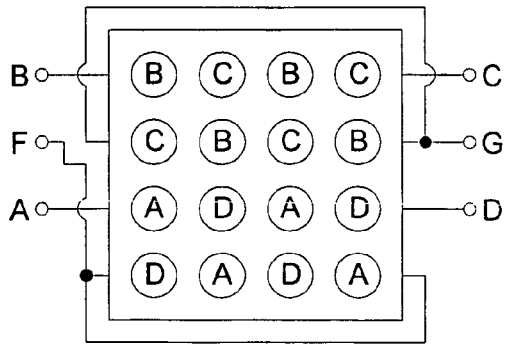
Figure 2C:
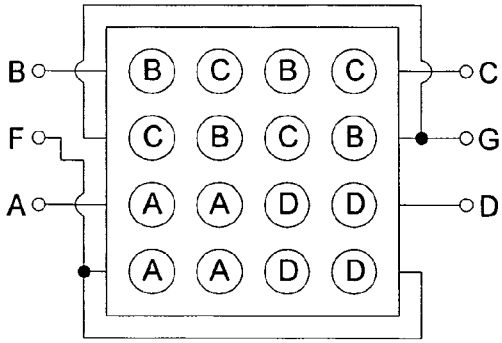

FIGS. 2A through 2C are schematic diagrams illustrating connection of interleaved half-display and/or quadrant groups of light emitting diodes within a programmable dichromatic illuminated display pushbutton switch according to one embodiment of the present invention. FIG. 2A illustrates a single circuit configuration with one common—that is, the entire display area is either not illuminated, illuminated in a first color, or illuminated in a second color. The input pins labeled "A," "B," "C," and "D" each correspond to one of the contacts 105 depicted in FIG. 1C, while the pin labeled "G" is the common or ground connection 111.

The LEDs, represented by circles, are connected and driven together by groups, with the letter assigned to a corresponding input pin used to designate the group to which each LED in the array belongs. Thus, for example, all of the LEDs labeled "B" are driven by applying a voltage to input pin B, completing a circuit through common or ground connection G. As may be seen, the LEDs in each half are interleaved, with adjacent LEDs belonging to different groups. In the single common configuration of FIG. 2A, pairs of input pins (e.g., A/B and C/D) are driven in tandem to illuminate the entire display area using the LEDs in both of two groups, one in the top half and one in the bottom. The display is illuminated in a first color or set of colors by applying an input voltage to input pins for one group in each half (e.g., A/B, A/C, or B/D) and illuminated in a second color or set of colors by applying the input voltage to the input pins for the remaining two groups. The illumination colors for the top and bottom halves may differ (e.g., green/red for the top half and white/amber for the bottom).

FIG. 2B illustrates a split circuit with two commons configuration, in which illumination of the upper and lower halves of the display area may be separately controlled. (The display area could alternatively be vertically divided by appropriately connecting and interleaving the LEDs). Each half of the display area is either not illuminated, illuminated in a first color, or illuminated in a second color, each independently of the other half. The top half of the display is illuminated in a first color by applying an input voltage to either of input pins B or C, and in a second color by applying the input voltage to the other input pin, completing a circuit through common or ground connection G in both cases. Similarly bottom half of the display is illuminated in a first color by applying an input voltage to either of input pins A or D, and in a second color by applying the input voltage to the other input pin, completing a circuit through common or ground connection F in both instances.

FIG. 2C illustrates a split circuit with two commons configuration in which illumination for one half of the display area is controlled by individual quadrants. In the configuration shown, the top half of the display may be illuminated in one of two colors. The bottom left and bottom right quadrants, however, may each be either not illuminated or illuminated in a single color (although the illumination color for the bottom left quadrant may differ from the color for the bottom right quadrant). In addition, both quadrants may be separately controlled and illuminated concurrently or individually.

Those skilled in the art will recognize that various permutations in dividing the display area between halves and/or quadrants is possible with appropriate connection (and, if necessary, interleaving) of the LEDs into groups controlled by applying an input voltage to a corresponding input pin. In the present invention, at least one half of the display area may be illuminated in either of two different colors.

Although light emitting diodes within an interleaved group or quadrant are independently switched through separate input pins to turn the light emitting diodes on or off, the driver circuits for each interleaved group or quadrant are identical and driven by the same control voltage to provide uniform voltage-controlled dimming. Moreover, to eliminate the bandgap problem associated with using different color light emitting diodes and to enable uniform voltage-controlled dimming of different color legends in a single illuminated pushbutton switch 100, each interleaved group or quadrant contains the same type of light emitting diode, having the same bandgap voltage (and voltage-luminance) characteristic. Light emitting diodes emitting a broad spectral radiance with a single bandgap are commercially available, and produce a narrow spectral radiance (typically blue) utilized to excite a broad spectral radiance fluorescence from a rare earth phosphor deposited within the light emitting diode package (i.e., "white" light emitting diodes). The combined spectral radiances of the light emitting diode and the phosphor emissions produce the appearance of a high color temperature white light source, with broad spectral radiance capable of producing a wide variety of colors including red, yellow, blue, green and white. In the present invention, each light emitting diode within array 104 is such a white light emitting diode.

Different colors of illumination are provided in the present invention through filters 107 disposed between light emitting diode array 104 and the legend plate 106, comprised of acrylic, polycarbonate, or glass materials, or a combination thereof. Filters 107 are selected to produce a specific chromaticity, as well as a desired luminance at one or more specific voltages. Through proper selection of filters 107, white light emitting diodes 104 may be employed to produce all colors desired. The color of each filter piece is selected to achieve the desire illumination color when the LEDs of a given group are switched on. Thus, for example, each filter piece disposed between an LED in group B and the legend plate 106 is the same color, as is each filter piece disposed between any LED in group A and the legend plate 106, any LED in group C and the legend plate 106, and any LED in group D and the legend plate 106. The colors for each of groups A-D, however, may all be different.

Optical filters 107 contain colorants, dyes and/or pigments known in the art which selectively remove white light emitting diode spectral radiance to match specific chromaticity requirements for illuminated pushbutton switch 100 (e.g., red, yellow, white, green or blue). In addition, filters 107 may optionally also contain specialized dyes for absorption of non-visible red or near infra-red spectral emissions from the white light emitting diodes 104 for the purpose of producing night vision imaging system (NVIS) compatible red, yellow, blue, green or white colors. Also, filters 107 may be formed of glass or plastic with suitable thin-film optical (interference) coatings to remove the red or near-infrared spectral emissions. Therefore, white light emitting diodes 104 may be filtered to produce any lighted legend color, including the standard aircraft illumination colors of blue, green, yellow, red and white or the NVIS colors of NVIS blue, NVIS white, NVIS green A (blue-green), NVIS green B (green), NVIS yellow (yellow) and NVIS red (orange-red).

Filters 107 are also designed to control the output luminance emitting from the display surface 110 of pushbutton cap 109 so that colored lighting produced from the white light emitting diodes will have approximately the same luminance at a specific voltage, such as 200-500 foot-lamberts (sunlight readable) at the maximum or full rated operating voltage.

Figure 3:
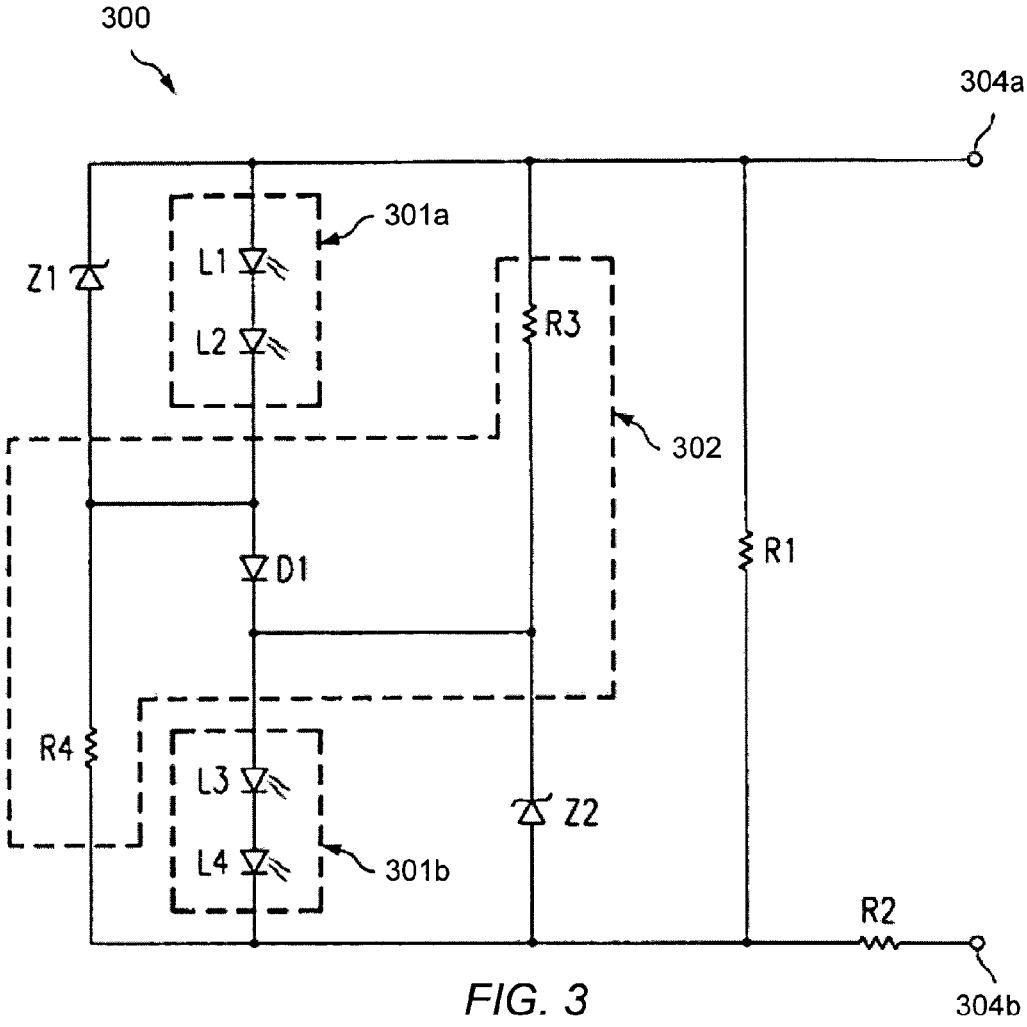
FIG. 3 is a circuit diagram for a voltage-controlled dimming light emitting diode driver employed within a programmable dichromatic illuminated display according to one embodiment of the present invention.

FIG. 3 is a circuit diagram for a voltage-controlled dimming light emitting diode driver employed within a programmable dichromatic display illuminated pushbutton switch according to one embodiment of the present invention. In the exemplary embodiment, individual but identical driver circuits, each implemented by circuit 300, are separately employed for each interleaved group or quadrant of the array 104—that is, one instance of the circuit 300 for the LEDs in group A, one instance for group B, etc.

Circuit 300 includes four white light emitting diodes L1-L4 from one of the interleaved groups or quadrants A-D, series-connected in pairs L1/L2 and L3/L4 within two LED sub-groups 301*a* and 301*b*. A switching circuit 302 is connected between LED sub-groups 301*a* and 301*b* to switch LED groups 301*a* and 301*b* from series-connection between input and output ports 304*a* and 304*b* to parallel-connection, or vice-versa, as the input voltage applied across input and output ports 304*a*-304*b* is varied across a threshold or "kickover" value. Switching circuit 302 includes a switching diode D1 connected in series between LED groups 301*a* and 301*b*, a first resistor R3 connected in parallel with both LED group 301*a* and switching diode D1, and a second resistor R4 connected in parallel with both LED group 301*b* and switching diode D1.

The cathode of switching diode D1 is connected to the anode of the last light emitting diode L2 (in the direction of the forward voltage drop across the LEDs) within LED group 301*a* and to one end of resistor R4; the anode of switching diode D1 is connected to the cathode of the first light emitting diode L3 with LED group 301*b* and to one end of resistor R3. An opposite end of resistor R3 is connected to the cathode of the first light emitting diode L1 within LED group 301*a*, and an opposite end of resistor R4 is connected to the anode of the last light emitting diode L4 within LED group 301*b*.

LED groups 301*a* and 301*b* (comprising light emitting diode pairs L1/L2 and L3/L4) are connected by switching circuit 302 either in series or in parallel between input and output ports 304*a*-304*b*, depending on the voltage applied across the input and output ports 304*a*-304*b*. Switching circuit 232 provides kickover from parallel-connection to series-connection, and vice-versa, of LED groups 301*a*-301*b* as the input voltage crosses a switching threshold. Switching diode D1 and resistors R3 and R4 enable the switching mechanism.

In operation, circuit 300 operates in two modes: high luminance mode above the kickover point, where the applied input voltage across ports 304*a*-304*b* is greater than the combined forward voltage drops (turn-on voltages) of light emitting diodes L1-L4 and switching diode D1; and low luminance mode below the kickover point, where the applied input voltage across ports 304*a*-304*b* is less than the combined forward voltage drops of light emitting diodes L1-L4 and switching diode D1 (but greater than the combined forward voltage drops of either of light emitting diode pairs l1/L2 or L3/L4).

In high luminance mode, switching diode D1 conducts, and most of the current between ports 304*a*-304*b* passes through the series connected path of light emitting diode pair L1/L2, switching diode D1, and light emitting diode L3/L4. The primary current path for high luminance control is established by the high luminance resistor R2.

In low luminance mode, switching diode D1 stops conducting and the current passes through the two parallel paths comprising: light emitting diode pair L1/L2 and resistor R4; and resistor R3 and light emitting diode pair L3/L4. Low luminance mode therefore results when the applied input voltage is insufficient to allow forward current to flow through switching diode D1. The primary current path for low luminance control is established by low luminance resistors R3-R4.

Resistor R1 provides a quiescent current path to prevent false or unintentional illumination at low current levels, which otherwise may produce detectable illumination at levels of as low as a few microamperes (μA). Resistor R1 is located to allow the rise in current across the resistor with applied voltage to halt at the combined forward voltage drops of light emitting diodes L1-L4 and switching diode D1, reducing unnecessary power dissipation at higher input voltages.

Zener diodes Z1 and Z2, in conjunction with high luminance resistor R2, provide circuit protection against transients, conducted electromagnetic susceptibility, or an electrostatic discharge event. When all four diodes L1-L4 illuminate a single quadrant of the display area, zener diodes Z1 and Z2 also prevent failure of the entire quadrant should a single light emitting diode L1-L4 fail in an electrically open state, by providing an alternate current path to maintain quadrant circuit integrity with two light emitting diodes still illuminating under such a catastrophic failure condition.

In addition to setting the kickover point as a function of input voltage applied across ports 304*a*-304*b*, resistor R2 serves to limit the current of a transient or overvoltage event and also serves to limit the operating current to safe levels in order to prevent a catastrophic failure of the display circuitry.

Because light emitting diodes 104 all having the same bandgap are utilized, programmable dichromatic display 100 may be dimmed using voltage-controlled dimming circuit 300 while maintaining the desired luminance uniformity from sunlight readability to night flying luminance levels regardless of what illumination color is employed. Component values for voltage-controlled dimming circuit 300 are also independent of the output illumination color since only one bandgap and voltage-luminance characteristic need be considered. The component values may differ for interleaved groups and quadrant group.

Uniform voltage-controlled dimming of multiple illumination colors utilizing a single control voltage is enabled for light emitting diode illumination sources in the present invention. Standardized luminance levels are achieved from light emitting diode illumination sources at approximately the same voltages at which the desired luminance is achieved under industry standards which have evolved with respect to incandescent lamps (e.g., sunlight readable luminance of at least 150-500 foot-lamberts at the full rated voltage of 28 VDC, commercial night flying luminance of about 10-30 foot-lamberts at approximately 14 VDC, military night-flying luminance of about 1 foot-lambert at approximately 7.2 VDC, and NVIS-compatible luminance of about 0.1 foot-lamberts at approximately 6.55 VDC). However, improved reliability, energy efficiency and operating lifetimes for illuminated displays are achieved through use of light emitting diodes rather than incandescent lamps. Moreover, the voltage-dependent chromaticity shifts seen for incandescent lamps are not detectable with white light emitting diodes.

It should be noted that the design of FIG. 3 also provides electrostatic discharge (ESD) protection for the light emitting diodes which is comparable to the inherent electrostatic discharge capabilities of incandescent lamps. Electrical transients within aircraft circuitry frequently spikes up to 600 VDC, with up to a 24 ampere (A) peak current for 10 microseconds. While incandescent lamps are essentially immune to those types of electrical transients encountered in aircraft circuitry, light emitting diodes are extremely susceptible to electrical transients, often failing when exposed to voltages of as low as 50 VDC. Circuit 300, however, provides electrical transient tolerance comparable to that exhibited by incandescent lamps while employing light emitting diodes instead.

Referring back to FIGS. 1A-1C and 2A-2C, the four individual driver circuits for pushbutton switch 100, each implemented as shown in FIG. 3, are preferably formed on a flex circuit in accordance with the known art, which may then be folded and fit within pushbutton cap 109. The four drivers on the flex circuit are separate, without interconnection. The input and output ports may be connected in either a common anode or common cathode configuration, with input port 304*a* for each circuit separately connected to one of input pins A, B, C or D, and output port 304*b* for all four circuits connected to one of common ground connections G or F (all four to G or two to G and two to F), or vice versa.

As illustrated by the different line patterns for filters 107 in FIG. 1E, the filter elements within the pushbutton cap 109 may be selected to produce different illumination colors, so that adjacent legends are illuminated in different colors on legend plate 106 and at least half of the legend plate may be selectively illuminated in either of two colors. Since all of the light emitting diodes 104 are of the same type and have the same bandgap voltage characteristics and the same voltage-luminance characteristics, all illumination colors will dim uniformly when the control voltage (a single control voltage, independent of illumination color) applied to light emitting diodes 104 in each interleaved group or quadrant is decreased to reduce luminance. Multiple legend regions illuminated in at least two different colors on the pushbutton cap 109 for a single illuminated pushbutton switch 100 will therefore all dim uniformly as the applied voltage is reduced. Legend regions that may be selectively illuminated in either of two different colors will also dim uniformly as the applied input voltage is reduced, regardless of whether the input voltage is applied to one input pin or the other providing illumination for that region.

Filters 107 in the exemplary embodiment are held by filter mount 108, which has openings therethrough for each filter in the exemplary embodiment and essentially serves as a frame holding the sixteen filters (or fewer filters for different arrangements of legends on display surface 110). When the illuminated pushbutton switch 100 depicted in FIGS. 1A-1F is assembled, the switch housing 101 will contain the pushbutton cap 109, including the pushbutton cap housing 102, the legend plate 106, filters 107, filter mount 108, and light emitting diode array 104, as well as the driver circuitry 300 for each interleaved group or quadrant.

All components for implementing the present invention, including the four individual driver circuits for the four interleaved groups or quadrants, fit within and are received and/or contained by pushbutton cap housing 102. Pushbutton cap 109 is preferably designed and sized to fit within a switch housing for a pushbutton switch employing incandescent lamp illumination, and operable with control elements within such an incandescent lamp-illuminated switch housing. No components necessary for the present invention are required to be located outside the pushbutton cap 109 (within, for example, switch housing 101). In this manner, existing illuminated displays with incandescent illumination may be retrofitted by replacement only of the pushbutton cap containing incandescent lamps with pushbutton cap 109 according to the present invention. The existing switch body need not be replaced to properly receive pushbutton cap 109 or to operate the illumination source within pushbutton cap 109. Retrofitting is accordingly simpler and less expensive than light emitting diode designs requiring components within the switch body or housing.

Referring back to FIGS. 1B-1C and 1F, each white light emitting diode within the array 104 is preferably a diffused top light emitting diode. Such diffused top white light emitting diodes are commercially available. Use of diffused top light emitting diodes improves both the viewing angle (the maximum angle from the perpendicular to the display surface 110 at which the illuminated legend is still visible) and the luminance uniformity across the illuminated legend. Reflectors (not shown) may also be provided within pushbutton cap 109 to further improve the viewing angle.

By adjusting the resistances within the driver circuit, a voltage-luminance characteristic for the switches illumination output from four LEDs may equal or at least approach the standards for sunlight readability, commercial and military night flying, and night vision imaging systems at the corresponding typical driving voltages (set according to incandescent bulbs).

By controlling the output color of illumination associated with a given group of commonly driven LEDs (e.g., A, B, C or D) and controlling application of a voltage to the associated driver(s), the legend for the switch may be illuminated in different colors to indicate different states. Each of these different illumination states and colors may indicate a different condition. In this manner, different color illuminations may be programmed to indicated different states or conditions via a single dedicated legend.

Different illumination colors may alternatively be achieved by using different color LEDs in each group, individually filtering LEDs for the different groups, or dip-coating the LEDs for the different groups. As noted above, incandescent sources may be substituted for the LEDs.

Although the present invention has been described in detail, those skilled in the art will understand that various changes, substitutions, variations, enhancements, nuances, gradations, lesser forms, alterations, revisions, improvements and knock-offs of the invention disclosed herein may be made without departing from the spirit and scope of the invention in its broadest form.

What is claimed is:

1. An illumination mechanism comprising:

a display surface for a pushbutton switch positioned over a plurality of light emitting diodes within a housing for the pushbutton switch, the display surface including a display area through which illumination from any activated one of the plurality of light emitting diodes is visible;

a first set of the plurality of light emitting diodes coupled to a first input pin for the pushbutton switch and illuminating the display area in a first color in response to application of a driving voltage to the first input pin; and a second set of the plurality of light emitting diodes coupled to a second input pin for the pushbutton switch and illuminating the display area in a second color in response to application of a driving voltage to the second input pin, wherein the driving voltage is selectively applied to the first input pin to illuminate the display area in the first color using the first set of light emitting diodes and to the second input pin to illuminate the display area in the second color using the second set of light emitting diodes, and wherein illumination of the display area in the first color indicates a first state of a switch mechanism within the pushbutton switch while illumination of the display area in the second color indicates a second state of the switch mechanism.

2. The illumination mechanism according to claim 1, wherein the second set of light emitting diodes are interleaved with the first set of light emitting diodes.

3. The illumination mechanism according to claim 1, wherein the first and second sets of light emitting diodes each comprise four interleaved diodes.

4. The illumination mechanism according to claim 1, wherein the first and second sets of light emitting diodes form two rows of light emitting diodes, each row comprising four diodes including diodes from the first set of light emitting diodes alternating with diodes from the second set of light emitting diodes.

5. The pushbutton switch illumination mechanism according to claim 1, further comprising:

a first driving circuit coupling the first set of light emitting diodes to the first input pin and to a common connection; and a second driving circuit coupling the second set of light emitting diodes to the second input pin and to the common connection.

6. An illumination mechanism comprising:

a first set of light emitting diodes within a housing for a pushbutton switch, the first set of light emitting diodes coupled to a first input pin for the pushbutton switch and illuminating a display area for the pushbutton switch in a first color in response to application of a driving voltage to the first input pin; and a second set of light emitting diodes within the housing, the second set of light emitting diodes coupled to a second input pin for the pushbutton switch and illuminating the display area in a second color in response to application of the driving voltage to the second input pin, the second set of diodes interleaved with the first set of diodes, wherein the driving voltage is selectively applied to the first input pin to illuminate the display area in the first color using the first set of light emitting diodes and to the second input pin to illuminate the display area in the second color using the second set of light emitting diodes.

7. The illumination mechanism according to claim 6, wherein the first and second sets of light emitting diodes each comprise four interleaved diodes.

8. The illumination mechanism according to claim 6, wherein the first and second sets of light emitting diodes form two rows of light emitting diodes, each row comprising four diodes including diodes from the first set of light emitting diodes alternating with diodes from the second set of light emitting diodes.

9. The pushbutton switch illumination mechanism according to claim 6, further comprising:

a first driving circuit coupling the first set of light emitting diodes to the first input pin and to a common connection; and a second driving circuit coupling the second set of light emitting diodes to the second input pin and to the common connection.

10. The pushbutton switch illumination mechanism according to claim 6, further comprising:

filter elements of the first color between each light emitting diode within the first set of light emitting diodes and the display area; and filter elements of the second color between each light emitting diode within the second set of light emitting diodes and the display area.

11. An illumination mechanism comprising:

a first set of four light emitting diodes coupled to a first input pin and illuminating a display area in a first color in response to application of a driving voltage to the first input pin; and a second set of four light emitting diodes coupled to a second input pin and illuminating the display area in a second color in response to application of the driving voltage to the second input pin, the second set of diodes interleaved with the first set of diodes, wherein the driving voltage is selectively applied to the first input pin to illuminate the display area in the first color using the first set of light emitting diodes and to the second input pin to illuminate the display area in the second color using the second set of light emitting diodes, wherein the first and second sets of light emitting diodes form two rows of light emitting diodes, each row comprising four diodes including diodes from the first set of light emitting diodes alternating with diodes from the second set of light emitting diodes, and wherein the display area comprises half of a display for a pushbutton switch or indicator, the illumination mechanism further comprising:

third and fourth sets of light emitting diodes illuminating a remaining half of the display in either a third or fourth color, respectively, wherein the third and fourth sets of light emitting diodes form two additional rows of light emitting diodes, each row comprising four diodes including diodes from the third set of light emitting diodes alternating with diodes from the fourth set of light emitting diodes.

12. The illumination mechanism according to claim 11, wherein the first and third sets of light emitting diodes are coordinately operated and the second and fourth sets of light emitting diodes are coordinately operated to concurrently illuminate both halves of the display in either the first and third colors or the second and fourth colors.

13. The illumination mechanism according to claim 11, wherein the first and third sets of light emitting diodes are independently operated and the second and fourth sets of light emitting diodes are independently operated to independently illuminate either or both halves of the display.

14. The illumination mechanism according to claim 11 wherein:

(a) the first and third colors are the same, (b) the second and fourth colors are the same, or (c) the first color is the same as the third color and the second color is the same as the fourth color.

15. The pushbutton switch illumination mechanism according to claim 11, wherein a single variable voltage is applied to one of the first and second input pins to dim illumination from the first or second set of light emitting diodes.

16. An illumination mechanism comprising:

a display surface for a pushbutton switch positioned over a plurality of light emitting diodes within a housing for the pushbutton switch, the display surface including a display area through which illumination from any activated one of the light emitting diodes is visible;

a first set of the light emitting diodes for which, when the first set of the light emitting diodes is activated, illumination visible through the display area is a first color; and a second set of the light emitting diodes for which, when the second set of the light emitting diodes is activated, illumination visible through the display area is a second color, wherein illumination in the first color indicates a first state of a switch mechanism within the pushbutton switch while illumination in the second color indicates a second state of the switch mechanism.

wherein the first and second sets of light emitting diodes form two rows of light emitting diodes, each row comprising four diodes including diodes from the first set of light emitting diodes alternating with diodes from the second set of light emitting diodes, and wherein the display surface comprises half of a display for the pushbutton switch, the illumination mechanism further comprising:

third and fourth sets of light emitting diodes illuminating a remaining half of the display in either a third or fourth color, respectively, wherein the third and fourth sets of light emitting diodes form two additional rows of light emitting diodes, each row comprising four diodes including diodes from the third set of light emitting diodes alternating with diodes from the fourth set of light emitting diodes.

17. The illumination mechanism according to claim 16, wherein the first and third sets of light emitting diodes are coordinately operated and the second and fourth sets of light emitting diodes are coordinately operated to concurrently illuminate both halves of the display surface in either the first and third colors or the second and fourth colors.

18. The illumination mechanism according to claim 16, wherein the first and third sets of light emitting diodes are independently operated and the second and fourth sets of light emitting diodes are independently operated to independently illuminate either or both halves of the display surface.

19. The illumination mechanism according to claim 16, wherein:

(a) the first and third colors are the same, (b) the second and fourth colors are the same, or (c) the first color is the same as the third color and the second color is the same as the fourth color.

20. The pushbutton switch illumination mechanism according to claim 16, wherein a single variable voltage is applied to one of the first and second input pins to dim illumination from the first or second set of light emitting diodes.

* * * * *